US011234509B2

(12) United States Patent
Baker et al.

(10) Patent No.: US 11,234,509 B2
(45) Date of Patent: Feb. 1, 2022

(54) ADJUSTMENT MECHANISM

(71) Applicant: Inojul (AUS) Pty Ltd, Ulverstone (AU)

(72) Inventors: Lee Baker, Richmond (AU); Kelly Watts, Richmond (AU); Michelle Rosevear, Richmond (AU); Drew Allan, Ulverstone (AU)

(73) Assignee: Inojul (AUS) Pty Ltd, Tasmania (AU)

( * ) Notice: Subject to any disclaimer, the term of this patent is extended or adjusted under 35 U.S.C. 154(b) by 133 days.

(21) Appl. No.: 16/328,119

(22) PCT Filed: Aug. 16, 2017

(86) PCT No.: PCT/AU2017/050871
§ 371 (c)(1),
(2) Date: Feb. 25, 2019

(87) PCT Pub. No.: WO2018/035557
PCT Pub. Date: Mar. 1, 2018

(65) Prior Publication Data

US 2019/0183241 A1 Jun. 20, 2019

(30) Foreign Application Priority Data

Aug. 26, 2016 (AU) ..... 2016903399

(51) Int. Cl.
*A47B 17/06* (2006.01)
*A47B 17/02* (2006.01)
*A47B 19/06* (2006.01)

(52) U.S. Cl.
CPC ..... *A47B 17/06* (2013.01); *A47B 17/02* (2013.01); *A47B 19/06* (2013.01)

(58) Field of Classification Search
CPC ..... A47B 17/02; A47B 17/06; A47B 19/06; A47B 23/02; A47B 23/04;
(Continued)

(56) References Cited

U.S. PATENT DOCUMENTS 7,617,569 B2 * 11/2009 Liao ..... B62B 3/12 16/297
8,898,862 B1 * 12/2014 McGralh ..... E05D 11/1007 16/326

(Continued)

FOREIGN PATENT DOCUMENTS

CN 201468452 U 5/2010

OTHER PUBLICATIONS

International Search Report & Written Opinion issued in PCT/AU2017/050871, dated Nov. 20, 2017, 7 pages.

(Continued)

*Primary Examiner* — Matthew W Ing
(74) *Attorney, Agent, or Firm* — Eversheds Sutherland (US) LLP

(57) ABSTRACT

An adjustment mechanism, including a first, second and third element pivotally connected to each other in series; locking mechanism to lock the respective elements in a selected position relative to each other; and a pushbutton actuating mechanism that releases the locking mechanism such that the elements are independently pivoted with respect to each other and release of the pushbutton actuating mechanism re-energizes the locking mechanism.

10 Claims, 9 Drawing Sheets

(58) Field of Classification Search
CPC .... A47B 2200/0042; A47B 2200/0043; A47B 2200/0044; A47B 27/14; A47B 27/18
See application file for complete search history.

(56) References Cited

U.S. PATENT DOCUMENTS

| | | | | |
|---|---|---|---|---|
| 9,399,882 | B1 * | 7/2016 | McGralh | E05D 11/1007 |
| 9,668,571 | B1 * | 6/2017 | Ghobadi | A47B 3/002 |
| 2002/0131814 | A1 * | 9/2002 | Hou | B62B 9/20 403/97 |
| 2005/0184211 | A1 * | 8/2005 | Yarbrough | A47B 23/04 248/445 |
| 2018/0206630 | A1 * | 7/2018 | Chang | A47B 13/081 |
| 2019/0038015 | A1 * | 2/2019 | Huang | A47B 9/02 |

OTHER PUBLICATIONS https://www.youtube.com/watch?v=7-7TwPqB2Q0 (published on Feb. 15, 2016).

* cited by examiner

ADJUSTMENT MECHANISM

CROSS-REFERENCE TO RELATED APPLICATIONS

This application is a national stage application, filed under 35 U.S.C. § 371, of International Application No. PCT/AU2017/050871, filed on Aug. 16, 2017, titled "Adjustment Mechanism," which claims priority to Australian Patent Application No. 2016903399, filed on Aug. 26, 2016, the entire contents of each of which are hereby incorporated herein by reference in their entirety for all purposes.

FIELD OF THE INVENTION

The present invention relates to a mechanism for the pivotal adjustment of elements relative to each other. The mechanism finds particular, though not exclusive, application in slopeboards, also known as angled boards, writing boards, slant boards and document holders, which are used to provide an angled surface for a user.

BACKGROUND OF THE INVENTION

Slopeboards sit on a desk surface in front of the user and a user places their paper, books or writing material on top of the slopeboard's surface. The surface is angled, typically at or around 20 degrees. This angle assists the user to maintain an upright sitting posture and a more extended wrist position whilst writing and also assists in the reading of documents or books.

There are numerous slopeboards available on the market, typically fitting into two categories, fixed or adjustable. Fixed slopeboards are those that have a set angle, typically 20 degrees, and are designed to stay stationary on a desk surface. Fixed slopeboards are therefore of a generally more robust construction than adjustable slopeboards.

Adjustable slopeboards are those that allow a user to choose the angle at which the board's working surface is positioned. They often include a hinged writing surface that is adjustable by moving a rear support along a series of notches to raise and lower the writing surface about the hinge. Such adjustable slopeboards typically collapse for storage or transport and may include a handle for carrying. These are usually lightweight to allow carrying by students between classrooms.

Alternative adjustable slopeboards include four screw-in feet that allow the overall height to be raised and lowered, and provide for minor adjustment to the angle of the writing surface. The adjustability of these types of slopeboards is quite restrictive, and adjustment is time-consuming.

It is therefore an object of the present invention to provide an alternative adjustment mechanism that can at least be used with a slopeboard to give the user a more dynamic ability to adjust the height and angle of the writing surface, or at least provide a useful alternative option.

Reference to any prior art in the specification is not an acknowledgment or suggestion that this prior art forms part of the common general knowledge in any jurisdiction or that this prior art could reasonably be expected to be understood, regarded as relevant, and/or combined with other pieces of prior art by a skilled person in the art.

SUMMARY OF THE INVENTION

According to a first aspect, the present invention provides an adjustment mechanism, including:

a first, a second and a third element pivotally connected to each other in series;

locking means to lock the respective elements in a selected position relative to each other; and a pushbutton actuating mechanism that releases the locking means such that the first, second and third elements are independently pivotal with respect to each other, and release of the pushbutton actuating mechanism re-engages the locking means.

Preferably, the first element is a body, with the second and third elements being legs such that the legs are independently pivotal with respect to each other and to the body, whereby the height and angle of the body can be adjusted.

In a preferred embodiment the body may include a panel having two ends, whereby a set of two legs are connected to each end of the panel.

According to a second aspect, the present invention provides an adjustable slopeboard, including:

a body having a main panel with two shoulders downwardly depending from respective sides of the main panel;

pivotally attached to each shoulder is a first leg and a second leg;

locking means to lock the respective first and second legs in a selected position relative to the body and each other; and respective pushbutton actuating mechanisms that release the locking means such that the first and second legs are independently pivotal with respect to each other and to the body, whereby the height and angle of the main panel can be adjusted, and release of the pushbutton actuating mechanisms re-engages the locking means.

The slopeboard is preferably symmetrical, such that the arrangements associated with each of the two shoulders are identical but arranged as mirror images.

It is preferable that each locking means includes two locking mechanisms, which may be independently released. Each pushbutton actuating mechanism may therefore have a two-stage depression, a half depression releasing a first locking mechanism and a full depression releasing both locking mechanisms.

The first locking mechanism preferably provides a locking engagement between a shoulder and the first leg, and the second locking mechanism provides a locking engagement between the first leg and the second leg.

Each of the legs may be spring-loaded, such that when a locking mechanism is released the leg is forced in a continuous downward rotation. This results, following full depression of the push button actuating mechanism, in all four legs pointing downwardly allowing the user to then push down on the platform against a table surface to obtain the desired height and angle before releasing the push button to lock the position. The degree of rotation may be limited. The first or second leg may become the forwardly extending leg, with the other leg extending rearwardly.

The locking mechanisms may be spring-loaded, such that they are biased into a locking engagement. The locking mechanisms may be interlocking teeth. The locking mechanisms can be provided as a series of radially arranged teeth.

The inside surface of the shoulder may include a disk having teeth that engage with the teeth of a first side of the first leg. The second leg may include teeth that engage with the second side the first leg. The first leg may include teeth on opposing sides, the first side engaging with the shoulder teeth and a second side engaging with the second leg.

Preferably, the half depression of the pushbutton actuating mechanism pushes the first and second legs away from the shoulder disengaging the interlocking teeth and allowing for rotation. The full depression of the pushbutton actuating mechanism may push the second leg away from the first leg disengaging the interlocking teeth and allowing for rotation.

Advantageously, the slopeboard is made from a thermoplastic polymer, such as polycarbonate or acrylic, more typically known as Plexiglass™. Such polymer may be transparent or opaque.

BRIEF DESCRIPTION OF THE DRAWINGS

Further aspects of the present invention and further embodiments of the aspects described in the preceding paragraphs will become apparent from the following description, given by way of example and with reference to the accompanying drawings, in which.

DETAILED DESCRIPTION OF THE EMBODIMENTS

Figure 1:
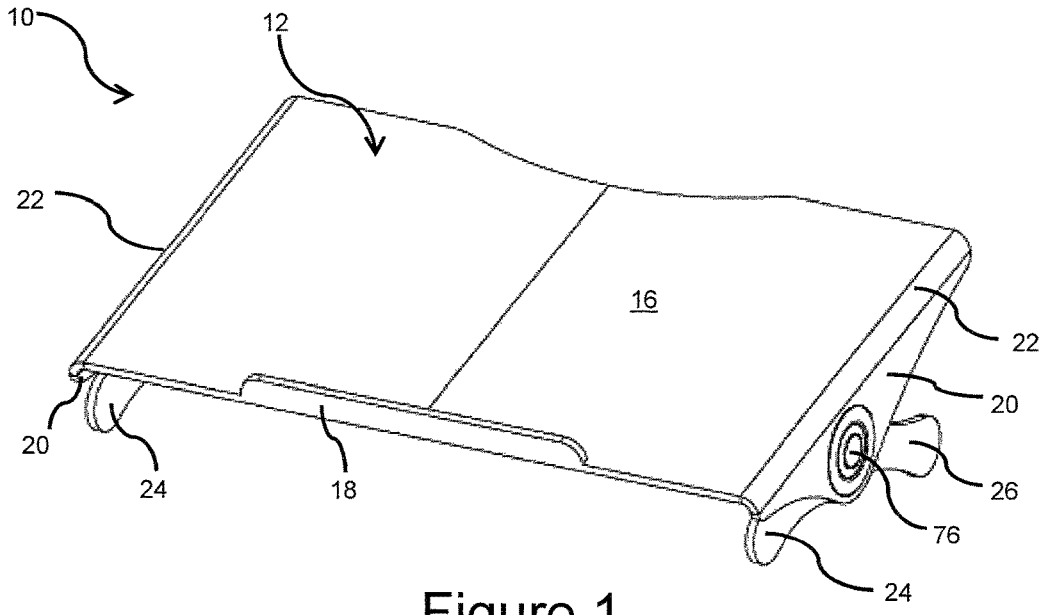
FIG. 1 is a perspective view of an adjustable slopeboard according to a preferred embodiment of the present invention.
Figure 2:
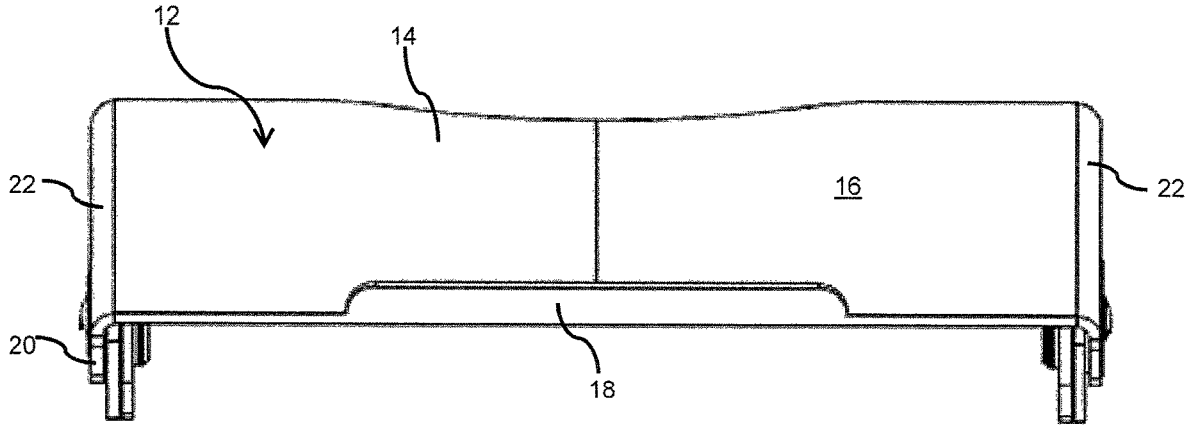
FIG. 2 is a front view of the slopeboard of FIG. 1.
Figure 3:
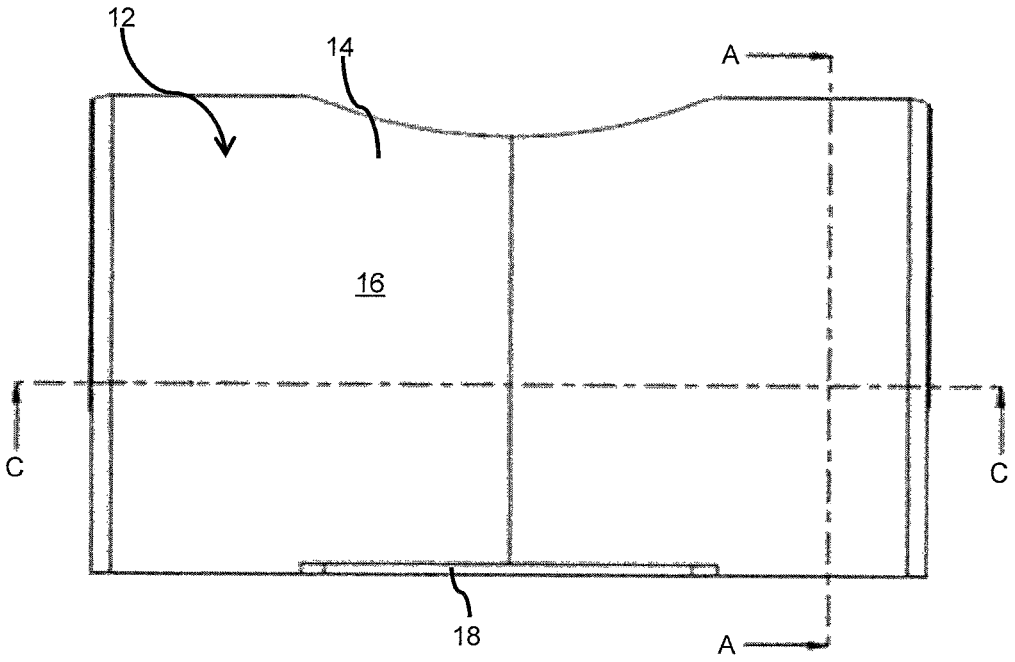
FIG. 3 is a top view of the slopeboard of FIG. 1.

FIG. 1 shows an adjustable slopeboard 10 according to a preferred embodiment of the present invention. The slopeboard includes a body 12 having a main panel 14 that comprises an upper writing surface 16. An upwardly projecting document stop 18 extends across a central section of the front edge of the main panel 14. The document stop 18 prevents books and documents from sliding forwards off the front of the slopeboard.

The slopeboard incorporates two adjustment mechanisms according to the present invention. On each side of the main panel 14 are two shoulders 20 that downwardly depend from respective sides of the main panel 14. In the embodiment illustrated the shoulders 20 are integrally formed with the main panel 14 with curved edges 22 being created.

Figure 4:
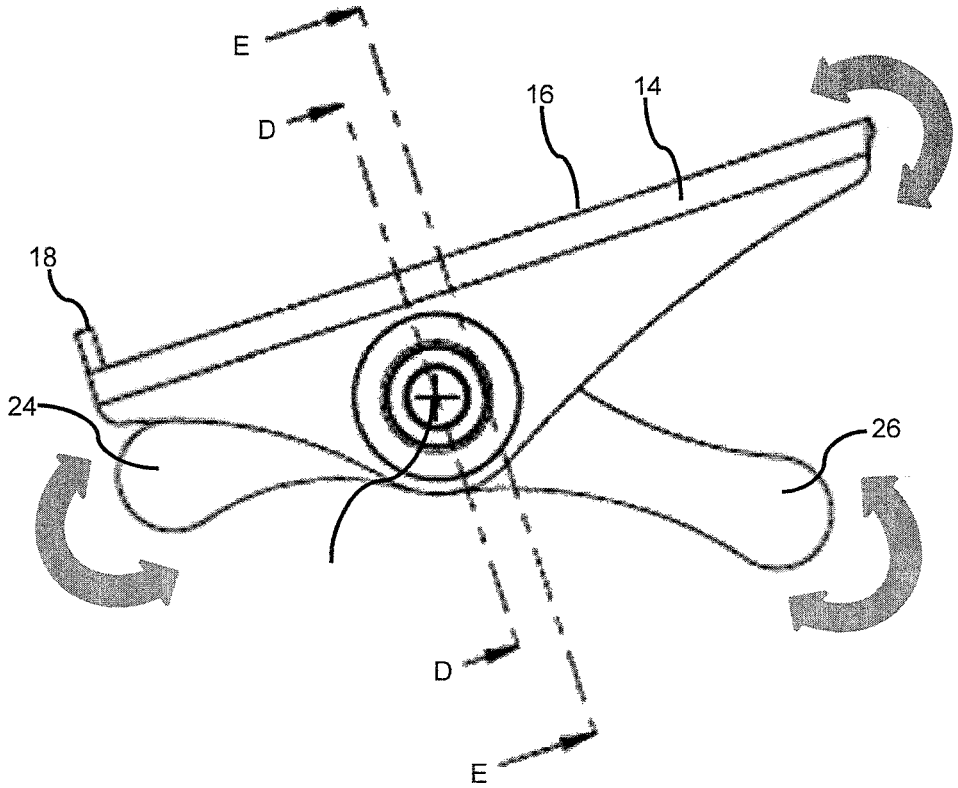
FIG. 4 is a side view of the slopeboard of FIG. 1.

Pivotally attached to each shoulder are a first leg 24 and a second leg 26. Each of the legs and the shoulder are able to pivot independently about a pivot axis 28, see FIG. 4. Locking means (to be described further below) are provided to lock the respective first and second legs in a selected position relative to the body. A push button actuating mechanism is provided that releases the locking means such the legs independently pivot with respect to each other and the body. This allows the height and angle of the main panel 14 to be adjusted by depressing two pushbuttons 30, one on either side of the body. Release of the pushbuttons 30 re-engages the locking means.

Figure 5:
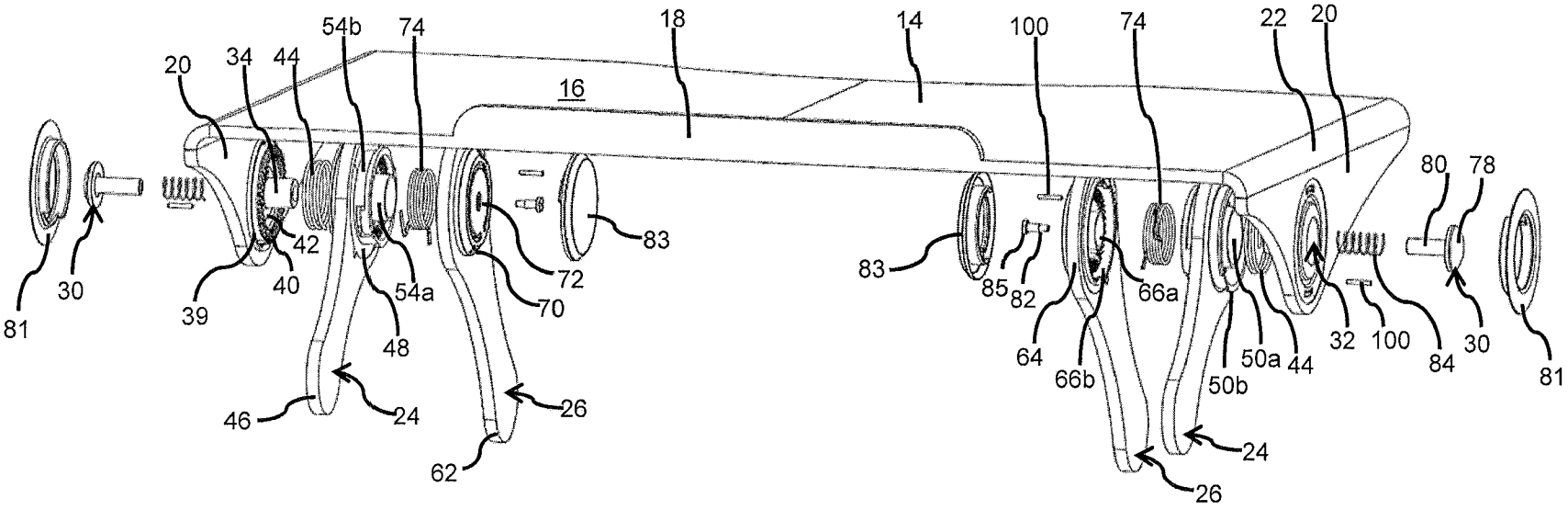
FIG. 5 is an exploded front perspective view of the slopeboard of FIG. 1.

FIG. 5 shows an exploded view of the slopeboard components. It will be appreciated that the two sides of the slopeboard include adjustment mechanisms that are mirror images of each other and therefore, whilst the following description relates to the right-hand side mechanism, it equally applies to the left-hand side.

Figure 6A:
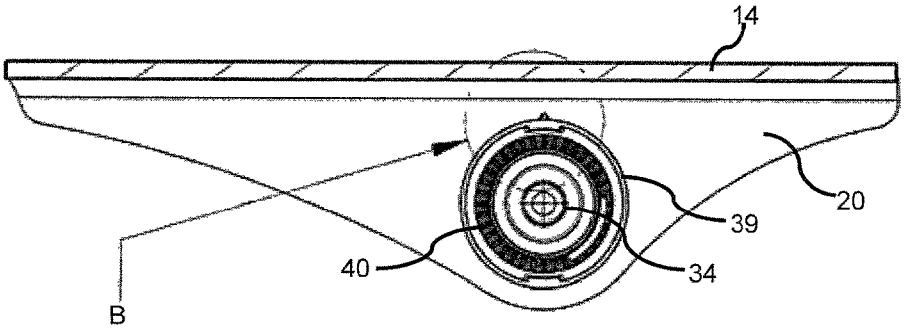
FIG. 6*a* is a cross-sectional side view through lines A-A of FIG. 3.
Figure 6B:
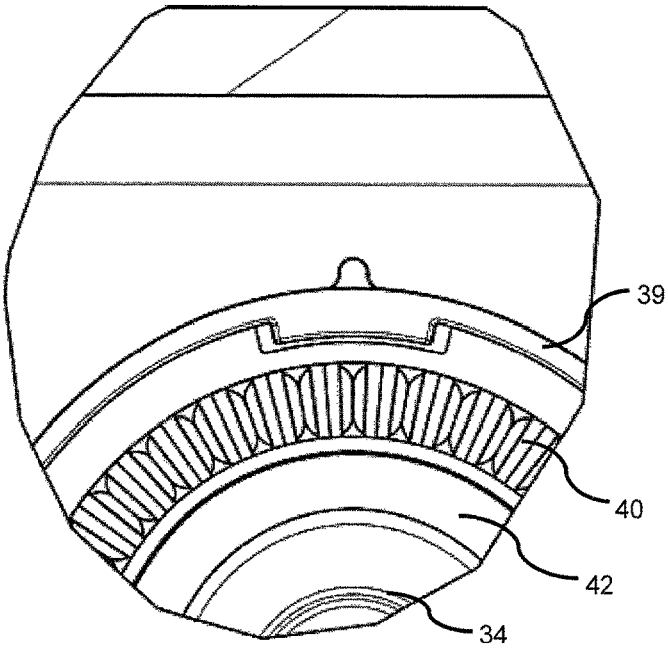
FIG. 6*b* is a close-up view of detail B of FIG. 6*a;*
Figure 6C:
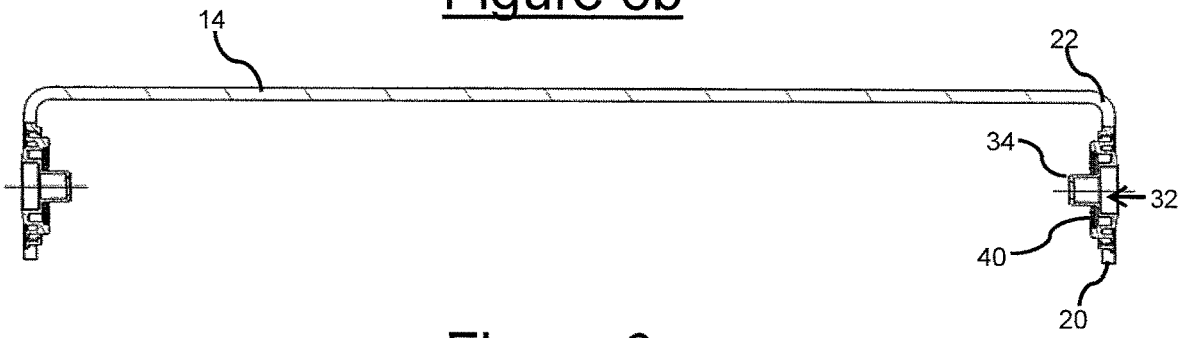
FIG. 6*c* is a cross-sectional front view through lines C-C of FIG. 3.

An aperture 32 extends through the shoulder 20 and an inwardly extending boss 34 (see FIG. 6*c*). The aperture 32 has a stepped profile (see FIG. 9*a*) with a void 36 narrowing at shoulders 60 into a narrower section extending through boss 34. On the inside surface of the shoulder 20 surrounding the boss 34 is a disk 39 that includes a plurality of radially arranged teeth 40. The disk 39 and teeth 40 project internally from shoulder 20 and create a recessed ring 42 to receive a portion of a first compression spring 44. The spring 44 sits between the shoulder 20 and first leg 24. It will be appreciated by a person skilled in the art that the disk 39 may be integrally formed with the shoulder or be provided as a separate insert.

Figure 7:
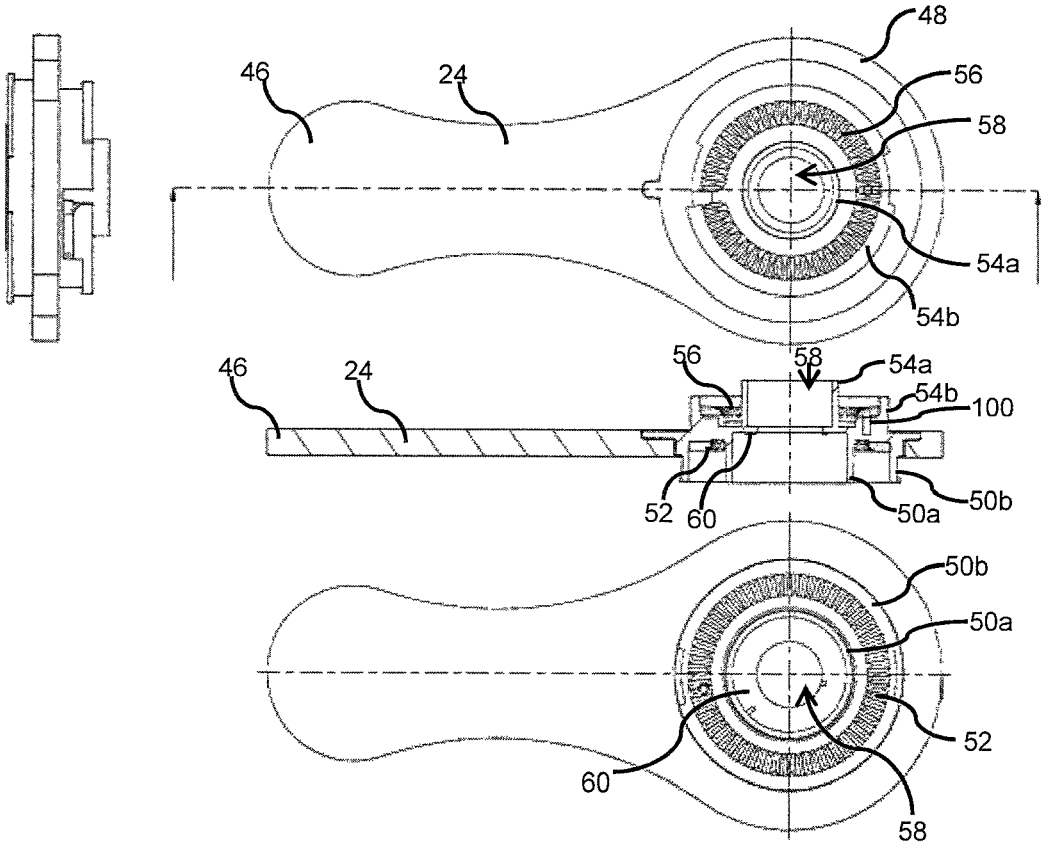
FIG. 7 is a dual side view, top view and end view of a right hand side first leg.

First leg 24 is elongate with rounded ends forming a foot 46 to contact an underlying surface and a pivot end 48. On the outer side of the first leg 24 at the pivot end 48 are two concentrically spaced apart outwardly extending bosses 50*a*, 50*b*. Positioned in the recess between the two bosses 50*a*, 50*b* is a plurality of radially arranged teeth 52 (see FIG. 7). Similarly, on the inner side of the first leg 24 are two concentrically spaced apart outwardly extending bosses 54*a*, 54*b*. Positioned in the recess between the two bosses 54*a*, 54*b* is a plurality of readily arranged teeth 56 (see FIG. 7). An aperture 58 extends centrally through the inner bosses 50*a*, 54*a*. As can be seen in cross-sectional views (such as FIG. 7 or 9*a*) the internal diameter of the two bosses 50*a*, 54*a* is different, creating a shoulder 60. Again, it will be appreciated by one skilled in the art that the bosses and teeth may be integrally formed with the leg or be provided as an insert.

Figure 8:
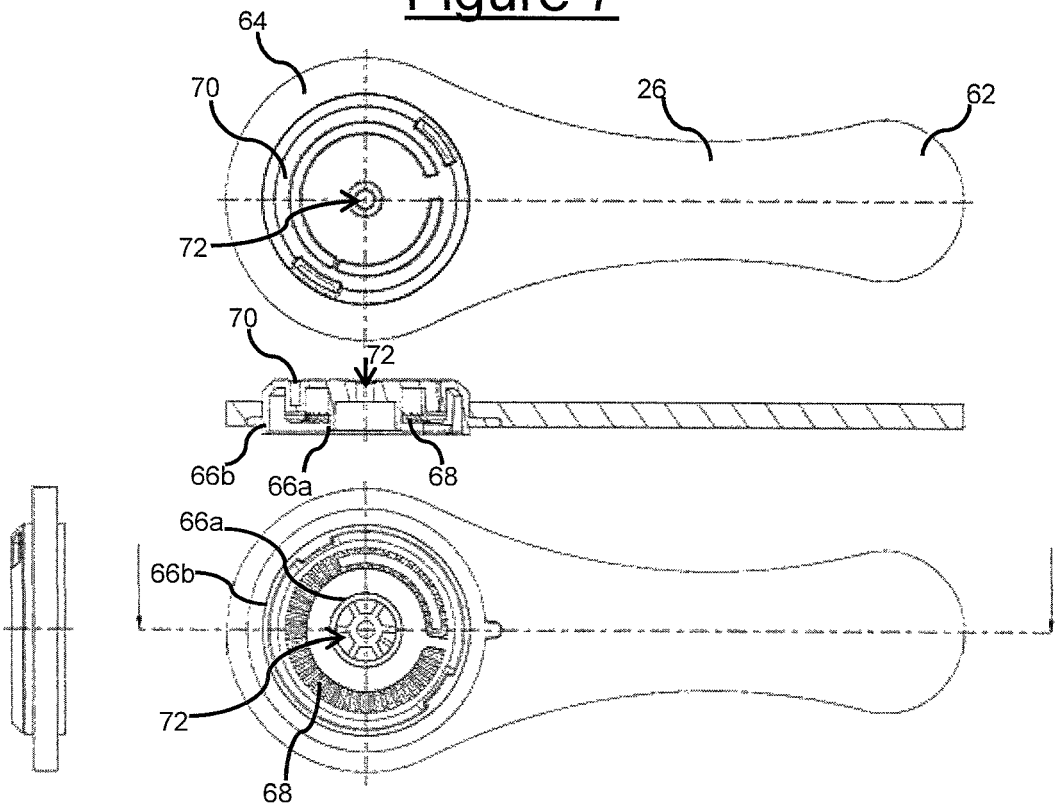
FIG. 8 is a dual side view, top view and end view of a left-hand side second leg.

The second leg 26 is also elongate with rounded ends forming a foot 62 to contact an underlying surface and a pivot end 64. On the outer side of the second leg 26 are two concentrically spaced apart outwardly extending bosses 66*a*, 66*b*. Positioned in the recess between the two bosses 66*a*, 66*b* is a plurality of radially arranged teeth 68 (see FIG. 8). The inner side includes a circular recess 70. A stepped aperture 72 extends through the pivot end 64 and central boss 66*a*. As with the first leg, the bosses, teeth and circular recess may be integrally formed or provided as an insert.

As can be seen in FIG. 5, first compression spring 44 sits between shoulder 20 and first leg 24. A torsion spring 74 sits between the first and second legs 24, 26. Extending through the three aligned apertures 32, 58, 72 is pushbutton 30. Pushbutton 30 has a bulbous end 78 and a shaft 80. The bulbous end 78 sits within void 36 and the shaft 80 extends through the apertures to connect with pin 82 to create a set distance between the bulbous end 78 and the pin head 85. Compression spring 84 sits around shaft 80 and holds the pushbutton 30 in the outward position shown in FIG. 9*a*. Caps 81, 83 are provided on the sides to conceal the mechanism from view.

Figure 9A:
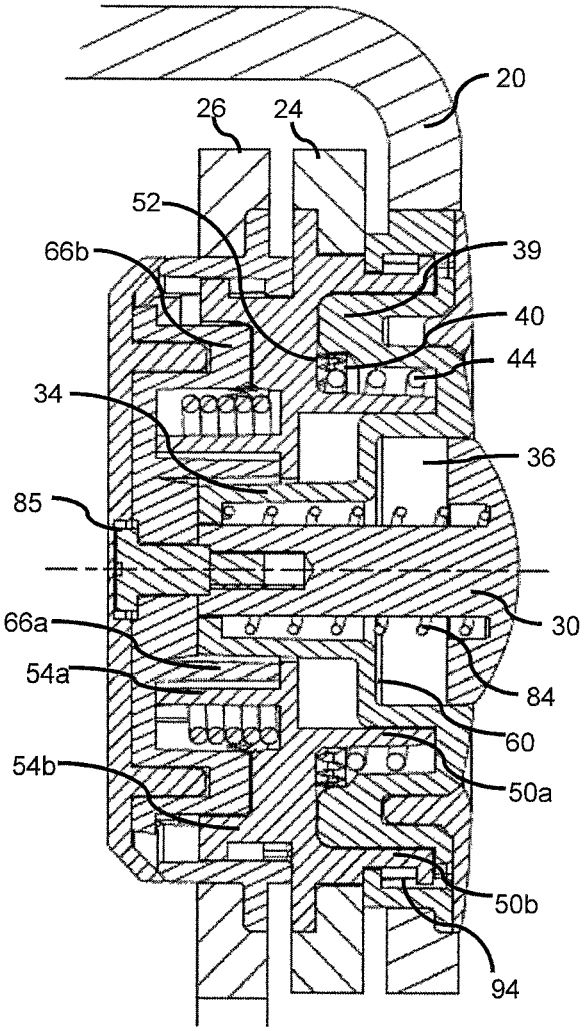
FIG. 9*a* is a cross-sectional view through lines D-D of FIG. 4 in a first configuration.
Figure 9B:
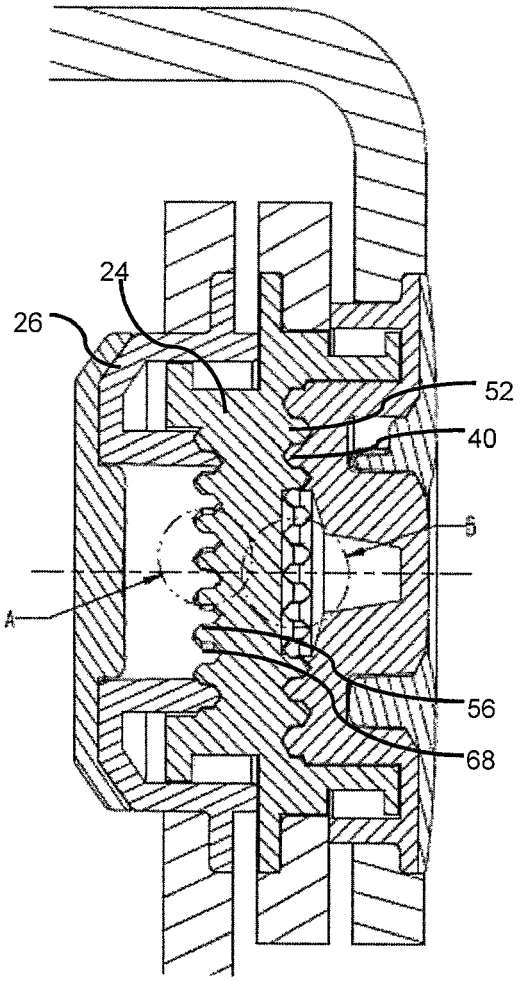
FIG. 9*b* is a cross-sectional view through lines E-E of FIG. 4 in a first configuration.

FIG. 9*a* shows the three components in a locked in position. In this configuration the first leg 24 interacts with the disk 39 of the shoulder 20 whereby boss 34 sits within aperture 58 of the first leg 24 projecting through void 36. The shoulder teeth 40 interlocked with the first leg teeth 52. This can be clearly seen in FIGS. 9*b* and 10*b*. The teeth are correspondingly shaped with shoulders 53 such that further rotation of the components with respect to each other is prevented when the teeth shoulders 53 mesh together. This is due to the compression spring 84, which biases the components into this locked arrangement.

Figure 10A:
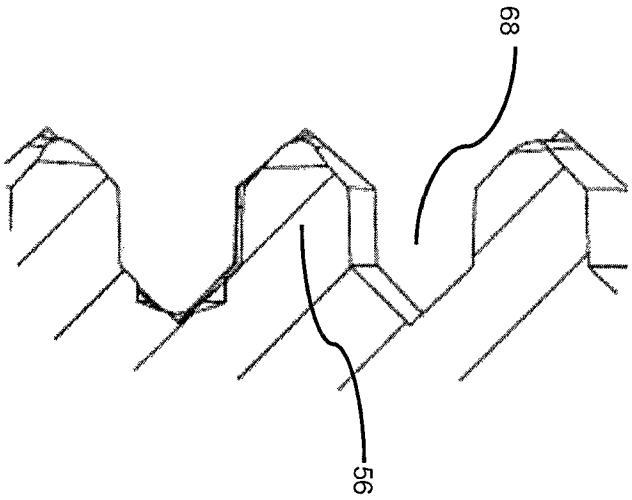
FIG. 10*a* is a close-up view of detail F of FIG. 9*b;*
Figure 10B:
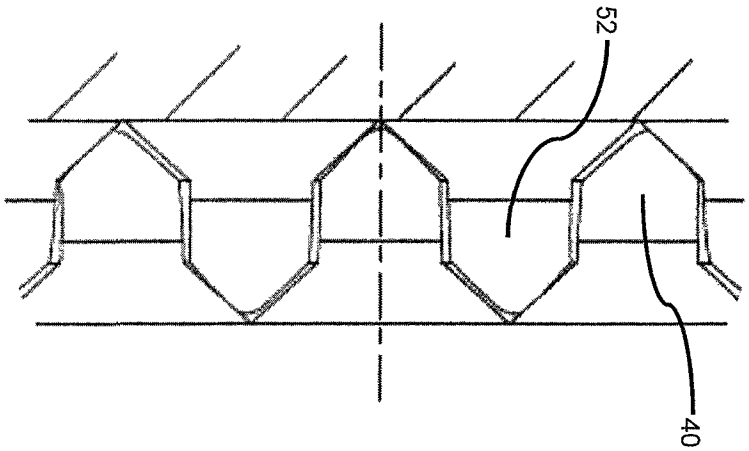
FIG. 10*b* is a close-up view of detail G of FIG. 9*b;*

The inner boss 66*a* of second leg 26 sits within the inner boss 54*a* first leg 24. First leg teeth 56 interlock with second leg teeth 68 preventing rotation of the components with respect to each other. The interlocked teeth are shown in FIG. 10*a*. It will be appreciated by one skilled in the art that the teeth shown in the embodiment may be altered with respect to size, shape and angles to maximise engagement.

Figure 11A:
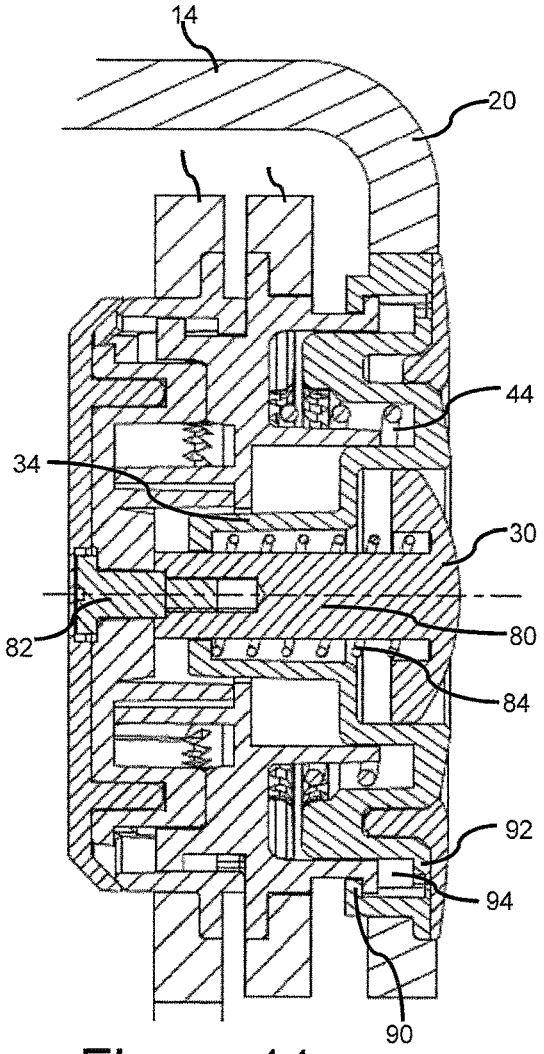
FIG. 11*a* is a cross-sectional view through lines D-D of FIG. 4 in a second configuration.
Figure 11B:
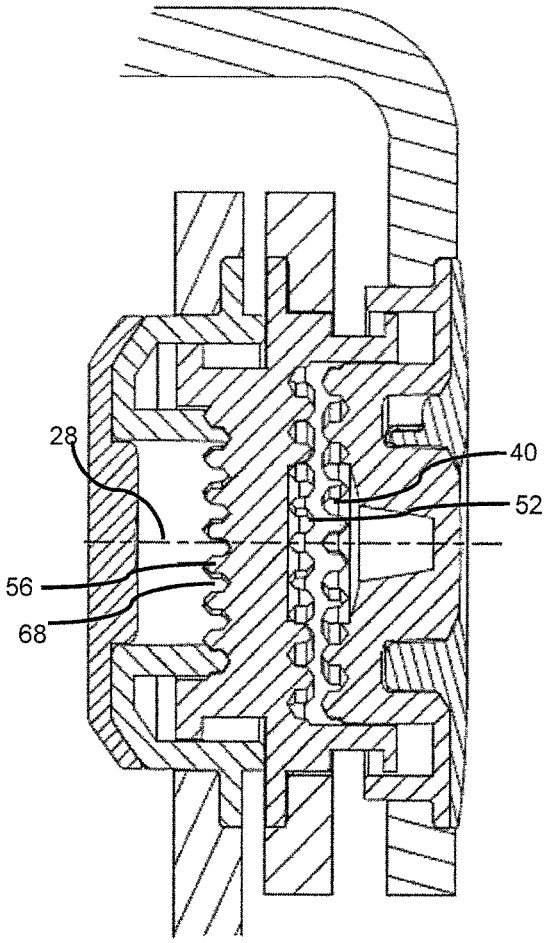
FIG. 11*b* is a cross-sectional view through lines E-E of FIG. 4 in a second configuration.

FIG. 11*a* shows the pushbutton 30 partially depressed. As the pushbutton is connected to the pin 82, depression of the pushbutton compresses the compression spring 84 and moves the end of shaft 80 through the end of boss 34. The compression in spring 84 pushes the first leg 24 away from shoulder 20 until overlapping flanges 90, 92 abut once travelling their maximum distance through void 94. This movement disengages teeth 40 from teeth 52 whilst teeth 56 and 68 remain interlocked. This is shown in FIG. 11*b*. This first stage of unlocking maintains the first and second legs in their orientation with respect to each other, allowing the main panel 14 to be tilted forwards or backwards about the pivot axis 28, adjusting the angular orientation of surface 16.

Figure 12A:
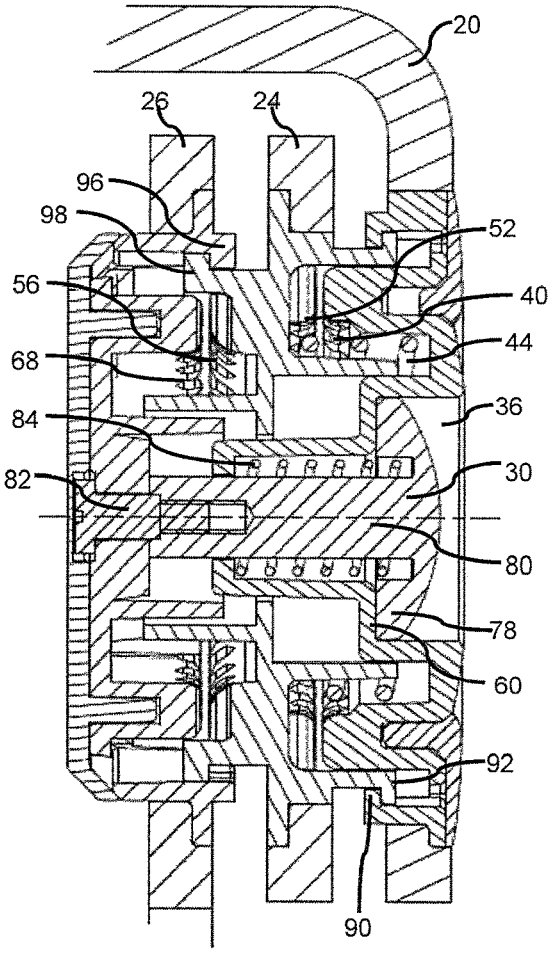
FIG. 12*a* is a cross-sectional view through lines D-D of FIG. 4 in a third configuration.
Figure 12B:
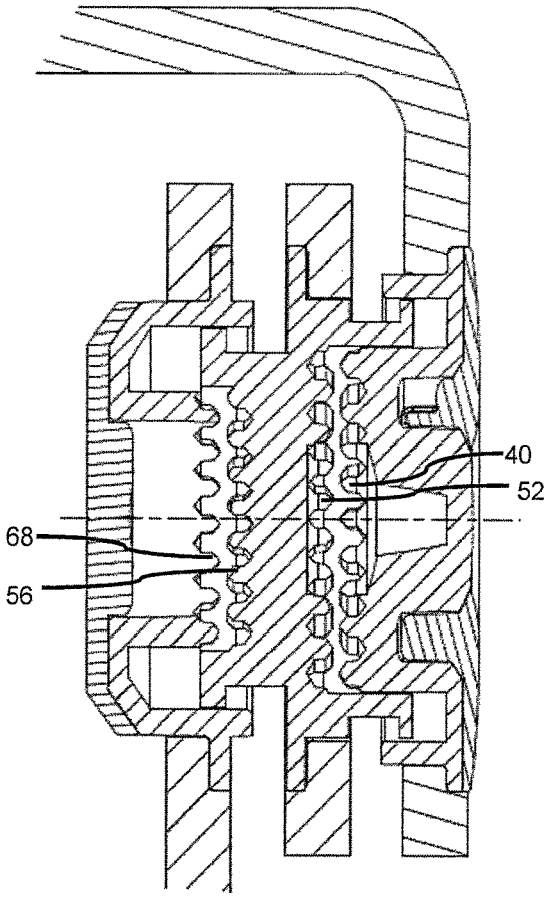
FIG. 12*b* is a cross-sectional view through lines E-E of FIG. 4 in a third configuration.

Further depression of the pushbutton 30 is shown in FIGS. 12*a* and 12*b*. Shaft 80 pushes second leg 26 away from the first leg 24, which is prevented from further travel due to flanges 90, 92. This movement of second leg 26 away from the first leg 24 disengages the interlocked teeth 56, 58, as shown in FIG. 12*b*. Bulbous head 78 abuts against shoulder 60 in the void 36 of the first leg 24, preventing further depression of pushbutton 78. Flanges 96, 98 and also head 85 of pin 82 prevent further movement of second arm 26 with respect to first arm 24. In this configuration each of the legs can be rotated independently thus adjusting both the height and the angle of main panel 14, whilst the pushbutton is held in.

Referring back to FIG. 5, torsion spring 74 can be seen between the first leg 24 and the second leg 26. The ends of the torsion spring 74 are connected to the respective first and second legs. The spring 74 biases the legs into a continuous downward rotation. When the platform is lifted, whilst pushbutton 30 is depressed, and the legs have no pressure on them, they are forced to extend downwardly. The user then pushes down on the main body 12 against a surface, which splays the legs apart.

Release of the pushbutton 78 halfway locks the first and second leg with respect to each other by re-engaging teeth 56, 58. This locks the height. Further release of the pushbutton 78 results in spring 84 biasing pushbutton 78 outwardly, which draws the first arm and second arm assembly towards shoulder 20, re-engaging teeth 40, 52. This locks the angular orientation of main panel 14.

Hex screws 100 are provided that limit the rotation of the legs, such that they cannot rotate further than 90 degrees from the main panel 14 increasing the usability of the system.

The main body and legs will typically be made from a transparent thermoplastic polymer, such as polycarbonate or acrylic, more typically known as Plexiglass™.

The present invention allows dynamic adjustment of the height and angle of components, such as those used in a slopeboard, which is faster to use, more accurate and provides greater adjustability to other adjustable slopeboards. The pushbutton operation of the adjustment mechanism disengages the locking teeth, allowing uninhibited smooth movement of the legs with respect to the main body. The locking mechanism is robust, allowing for a high weight capacity, providing for diversified use.

It will be understood that the invention disclosed and defined in this specification extends to all alternative combinations of two or more of the individual features mentioned or evident from the text or drawings. All of these different combinations constitute various alternative aspects of the invention.

The invention claimed is:

1. An adjustment mechanism, including:

a first, a second and a third element each connected to a common aligned pivot axis and each capable of pivoting independently about the common aligned pivot axis;

locking means aligned with the pivot axis to lock the respective first, second and third elements in a selected position relative to each other; and a pushbutton actuating mechanism that releases the locking means such that the first, second and third elements are independently pivotal with respect to each other, and release of the pushbutton actuating mechanism re-engages the locking means.

2. An adjustment mechanism according to claim 1, wherein the first element is a body, with the second and third elements being legs such that the legs are independently pivotal with respect to each other and to the body, whereby height and an angle of the body can be adjusted.

3. An adjustment mechanism according to claim 2, wherein the body includes a panel having two ends, whereby a set of two legs are connected to each end of the panel.

4. An adjustment mechanism according to claim 1, wherein each locking means includes two locking mechanisms, which may be independently released.

5. An adjustment mechanism according to claim 4, wherein each pushbutton actuating mechanism has a two-stage depression, a half depression releasing a first locking mechanism of the two locking mechanisms and a full depression releasing the two locking mechanisms.

6. An adjustment mechanism according to claim 4, wherein a first locking mechanism of the two locking mechanisms provides a locking engagement between the first element and the second element, and a second locking mechanism of the two locking mechanisms provides a locking engagement between the second element and the third element.

7. An adjustment mechanism according to claim 4, wherein the two locking mechanisms are spring-loaded, such that the two locking mechanisms are biased into a locking engagement.

8. An adjustment mechanism according to claim 4, wherein the two locking mechanisms are interlocking teeth.

9. An adjustment mechanism according to claim 8, wherein each pushbutton actuating mechanism has a two-stage depression, a half depression releasing a first locking mechanism of the two locking mechanisms and a full depression releasing the two locking mechanisms; and wherein the half depression of the pushbutton actuating mechanism pushes the second and third elements away from the first element, disengaging the interlocking teeth and allowing for rotation and wherein the full depression of the pushbutton actuating mechanism pushes the third element away from the second element, disengaging the interlocking teeth and allowing for rotation.

10. An adjustment mechanism according to claim 1, wherein the first, second and third elements each have an aperture, which are aligned, and wherein the push button actuating mechanism includes a shaft that extends through the aligned apertures of the first, second and third elements.

* * * * *